US008555787B2

(12) United States Patent
Haaf

(10) Patent No.: US 8,555,787 B2
(45) Date of Patent: Oct. 15, 2013

(54) SHUTTLE PALLET FOR A STORAGE SYSTEM

(75) Inventor: Dietrich Haaf, Stuttgart (DE)

(73) Assignee: CABKA GmbH, Weira (DE)

( * ) Notice: Subject to any disclaimer, the term of this patent is extended or adjusted under 35 U.S.C. 154(b) by 425 days.

(21) Appl. No.: 12/741,379

(22) PCT Filed: Oct. 2, 2008

(86) PCT No.: PCT/EP2008/008335

§ 371 (c)(1),
(2), (4) Date: May 5, 2010

(87) PCT Pub. No.: WO2009/059667

PCT Pub. Date: May 14, 2009

(65) Prior Publication Data

US 2010/0236456 A1 Sep. 23, 2010

(30) Foreign Application Priority Data

Nov. 6, 2007 (DE) ..... 10 2007 054 521

(51) Int. Cl.
*B65D 19/12* (2006.01)

(52) U.S. Cl.
USPC ..... 108/56.3; 108/57.19; 108/901

(58) Field of Classification Search
USPC ..... 108/901, 902, 51.11, 53.1, 56.1, 56.3, 108/57.17, 57.18, 57.19, 57.25, 57.29, 108/57.33, 57.34
See application file for complete search history.

(56) References Cited

U.S. PATENT DOCUMENTS

| | | | | |
|---|---|---|---|---|
| 2,643,080 | A * | 6/1953 | Vogel | 108/51.3 |
| 2,930,481 | A * | 3/1960 | Bebie | 206/597 |
| 3,361,092 | A * | 1/1968 | Budd | 108/57.34 |
| 3,523,507 | A | 8/1970 | Dubin | |
| 4,869,179 | A * | 9/1989 | Sammons et al. | 108/56.1 |
| 5,272,990 | A * | 12/1993 | Carter | 108/51.3 |
| 5,456,189 | A | 10/1995 | Belle Isle | |
| 5,460,103 | A * | 10/1995 | Dunn et al. | 108/57.18 |
| 5,588,372 | A * | 12/1996 | Kelly | 108/55.1 |
| 6,105,512 | A * | 8/2000 | Lin | 108/56.3 |
| 6,766,749 | B2 * | 7/2004 | Lacabanne | 108/56.3 |
| 6,954,982 | B2 * | 10/2005 | Isle et al. | 29/799 |
| 2006/0230988 | A1 * | 10/2006 | Berg et al. | 108/57.25 |

FOREIGN PATENT DOCUMENTS

| | | | |
|---|---|---|---|
| DE | 4242472 | A1 * | 6/1994 |
| DE | 102004034094 | A | 2/2006 |
| EP | 0515578 | A | 12/1992 |
| EP | 1705130 | A | 9/2006 |
| GB | 1184575 | A | 3/1970 |

* cited by examiner

*Primary Examiner* — Hanh V Tran
*Assistant Examiner* — Andres F Gallego
(74) *Attorney, Agent, or Firm* — Gudrun E. Huckett

(57) ABSTRACT

A shuttle pallet for a high rack storage facility has three longitudinal supports extending parallel to each other. Load bearing bridges orthogonally extend relative to the longitudinal supports. The longitudinal supports and the load bearing bridges are connected to one another in an articulated fashion. The longitudinal supports are made of a wear-resistant and bending-resistant semi-finished product and are form-fittingly and exchangeably connected to the load bearing bridges. The longitudinal supports have in cross-section an area with a circular ring-shaped cross-section. The load bearing bridges have legs. Snap-on-connectors with a circular segment-shaped cross-section are formed on the legs. The longitudinal supports are supported with the circular ring-shaped cross-section rotatably about an axis of rotation and exchangeably in the snap-on connectors, respectively. The axis of rotation extends in a direction of a longitudinal axis of the longitudinal supports.

17 Claims, 8 Drawing Sheets

SHUTTLE PALLET FOR A STORAGE SYSTEM

BACKGROUND OF THE INVENTION

In automated storage systems, for example, high rack storage facilities, transport pallets, preferably so-called wooden Euro pallets, are transported automatically by roller conveyors, chain conveyors, rack servicing devices and/or other devices, moved to the desired storage location of the storage system, and removed as needed.

It is known that the employed wooden pallets partially cause significant operational disturbances; in particular by using low quality wood material in the wooden pallets that are supplied from the outside to the storage system, the number and the severity of operational disturbances appear to be increasing.

Even when undamaged wooden pallets are introduced into the storage system, the load on the skids caused by the conveying equipment can lead to damage on the wooden pallets and thus to operational disturbances.

Low quality wooden pallets have generally also relatively strong deviations of their geometry relative to the nominal dimensions set by standards; this also may cause disturbances.

This has the results that, for example, in storage systems that only store their own wooden pallets, particularly expensive wooden pallets of select wood pieces are used. This solution cannot be employed in storage systems that primarily store pallets that are delivered by third parties.

Moreover, in many storage system there is the need to store also pallets with smaller major dimensions than the standard pallets (half pallets, quarter pallets) in a mix with standard pallets.

In order to avoid these problems, DE 42 42 472 A1 discloses a support structure for wooden pallets that is substantially comprised of a shell that is precisely dimensioned to match the bottom side of the wooden pallets. Into this shell the loaded wooden pallet is inserted before entering the storage system and removed again after leaving the storage system. This solution however has not found acceptance in practice.

Known automated storage systems require conventionally the use of pallets with skids, inter alia because of the employed roller conveyors. The use of inexpensive nesting pallets that generally do not comprise skids and therefore cannot be conveyed on roller conveyors is thus impossible.

Plastic pallets with skids that are not provided with special devices, for example, steel reinforcements, also generally cannot be employed in automated storage systems because the deformation caused essentially by creeping of the plastic material may cause operational disturbances. By means of complex auxiliary supports that additionally support the pallets across the bridged length, the problem of deformation can be solved.

At the same time, plastic pallets with skids are basically considered to be operationally safer than wooden pallets because of their geometric integrity and dimensional stability. Therefore, sometimes high-quality plastic pallets are used in automated high rack storage facilities. These expensive pallets are however subject to significant wear.

SUMMARY OF THE INVENTION

The invention has the object to avoid the operational disturbances caused by wooden pallets in automated storage systems and to enable the use even of damaged pallets and the storage of half pallets or quarter pallets. Moreover, the use of nesting transport pallets that usually do not have skids should also be enabled in storage systems of the aforementioned kind.

This object is solved according to the invention by a shuttle pallet for a high rack storage facility that is furnished with storage locations designed for storing goods positioned on pallets, wherein the shuttle pallet comprises three longitudinal supports arranged parallel to one another, at least two load bearing bridges extending orthogonally to the longitudinal supports, wherein the longitudinal supports and the load bearing bridges are connected in articulated fashion with one another.

Advantages of the Invention

By using an additional shuttle pallet, "deficiencies" of the pallets to be stored are eliminated. For example, transport pallets of wood whose dimensions no longer comply with the prescribed standard dimensions or from which smaller parts have been chipped off, can be placed onto the shuttle pallet according to the invention. The transport pallet with the goods stored thereon is then transported together with the shuttle pallet within the automated storage system, for example, by roller conveyors, chain conveyors, rack servicing devices and others, and finally deposited for storage at a storage location and removed again as needed. In this connection, only the shuttle pallet according to the invention is in contact with the roller conveyors, chain conveyors, rack servicing devices, and the storage locations of the storage system, the transport pallet has no direct contact with the storage system so that deficiencies of the transport pallets will not affect the storage system. As a result of this, the deficiencies of the transport pallets can be eliminated and the shuttle pallets according to the invention can be optimized entirely with respect to the requirements of the storage system.

In order to enable low-wear gliding as much as possible of the shuttle pallet in particular on the roller conveyor, the legs of the load bearing bridges are designed according to the invention in such a way that the longitudinal supports can move relative to one another in the XZ plane wherein the movement is impressed by unevenness of the roller conveyor. Accordingly, the legs are advantageously designed as springy joints, in particular as leaf spring-like joints that enable small movements.

In an advantageous embodiment of the invention, it is provided that the longitudinal supports are comprised of a wear-resistant and bending-resistant semi-finished product, in particular of a tubular section of construction steel or aluminum and particularly preferred of a pipe with circular ring-shaped cross-section with or without flat portion. In this way, the contact of the roller conveyors and the chain conveyors with the longitudinal supports of construction steel or a material with smaller modulus of elasticity can be limited. Because of their material, these longitudinal supports are naturally very wear-resistant and therefore can be used for a long period of time without noticeable wear.

Other longitudinal supports according to the invention are comprised of profiled sections with bending-resistant cross-section that have a larger contact area on the running surface relative to the conveying equipment (roller conveyors etc.) than a pipe with circular ring-shaped cross-section in order to reduce the contact pressure and the stress caused by it. According to the invention, this can be, for example, a pipe that is flattened to form the running surface but is otherwise substantially a circular ring-shaped tube, or a T-shaped profile. Of course, this can also be achieved by any other profiles with bending-resistant cross-section that have at the running surface a larger contact area relative to the conveying equipment. In this way, the contact pressure (Hertzian stress) between longitudinal supports and, for example, the rollers of a roller conveyor is reduced and in this way the thereby occurring stress is reduced.

The Hertzian stress can be further reduced when a material with small modules of elasticity in comparison to steel is employed. This can be, for example, aluminum.

Moreover, by means of the longitudinal supports according to the invention made of a bending-resistant profiled section, even heavily loaded transport pallets can be stored at the storage locations of the high rack storage facility on transverse beams because the longitudinal supports according to the present invention have satisfactory bending stiffness.

In order to ensure that from the load bearing bridges the weight force of the goods supported thereon is introduced safely into the longitudinal supports, legs are formed on each load bearing bridge.

Advantageously, the longitudinal supports are secured only by form fit against falling out in case the shuttle pallet is lifted.

Especially preferred, the longitudinal supports are connected by a snap-on connection or a clip connection with the load bearing area for bridges. When the connection is detachably designed, it is also possible to exchange individual longitudinal supports or even individual load bearing bridges in case of damage so that the economic efficiency of the shuttle pallets according to the invention is further improved.

In a further advantageous embodiment of the invention, it is provided that the load bearing bridges are embodied in a direction orthogonal to the longitudinal supports in a bending resistant way. In a further advantageous embodiment of the invention it is provided that between two load bearing bridges spacers are provided that extend in the direction of the longitudinal supports. In this way it is ensured that the load bearing bridges cannot move relative to one another. As a result of this the dimensions of the shuttle pallets according to the invention will not change even under heavy and frequent loading and a problem-free and disruption-free operation in automated storage systems is ensured.

The spacers and the load bearing bridges can be designed as a monolithic part. As a result of this, for completing the shuttle pallet according to the invention, it is only required to clip the longitudinal supports that are preferably comprised of a tube with circular ring-shaped cross-section onto the load bearing bridges. The load bearing bridges can be made preferably of plastic material, in particular HDPE and/or recycled plastic material. In this way, even complex geometries and a weight-optimized construction can be realized easily.

In order for the shuttle pallet according to the invention to be liftable and transportable by rack servicing devices, forklifts and others, it can be provided that between the longitudinal supports on the bottom side of the shuttle pallet two cutouts extending in longitudinal direction are provided. Advantageously, the spacing of the central axes of the cutouts is between 340 mm and 400 mm and particularly preferred 370 mm.

The height of the cutouts is advantageously greater than 85 mm and the width of the cutouts is greater than 160 mm.

In a further advantageous embodiment of the invention, it is provided that the dimensions of the shuttle pallet, in particular its length and width, match at least the standard dimensions of so-called transport pallets, in particular Euro pallets. In this way, it is firstly possible to place the standardized transport pallets onto the shuttle pallets and the shuttle pallets according to the invention can be inserted into already existing high rack storage facilities. For this purpose it may optionally only be required to enlarge the height of the storage locations somewhat, namely by the height of the shuttle pallet according to the invention.

In order to further improve the force introduction between the transport pallet placed onto the shuttle pallet according to the invention and the longitudinal supports, in a further advantageous embodiment of the invention it is provided that at a topside of the shuttle pallet load bearing points are formed wherein the spacing of the load bearing points relative to one another corresponds to the spacings of the legs of a standardized pallet, in particular a Euro pallet. In this way, the force introduction from the transport pallet into the shuttle pallet is concentrated on defined load bearing points. It is particularly advantageous when the load bearing points are arranged vertically above the legs of the shuttle pallet. In this way, the bending loads resulting from weight forces between the transport pallet and the shuttle pallet are minimized.

In order to reduce wear of the shuttle pallet according to the invention at the topside in the area of the load bearing points, according to a further advantageous embodiment of the invention it can be provided to reinforce the shuttle pallet in the area of the load bearing points, in particular by shells of a wear-resistant material, for example, sheet steel.

Further advantages of advantageous embodiments of the invention will be disclosed in the subsequent drawing, its description, and the claims. All features disclosed in the drawing, its description, and the claims may be important for the invention taken alone or in any combination with one another.

BRIEF DESCRIPTION OF THE DRAWING

It is shown in.

DESCRIPTION OF PREFERRED EMBODIMENTS

Figure 1:
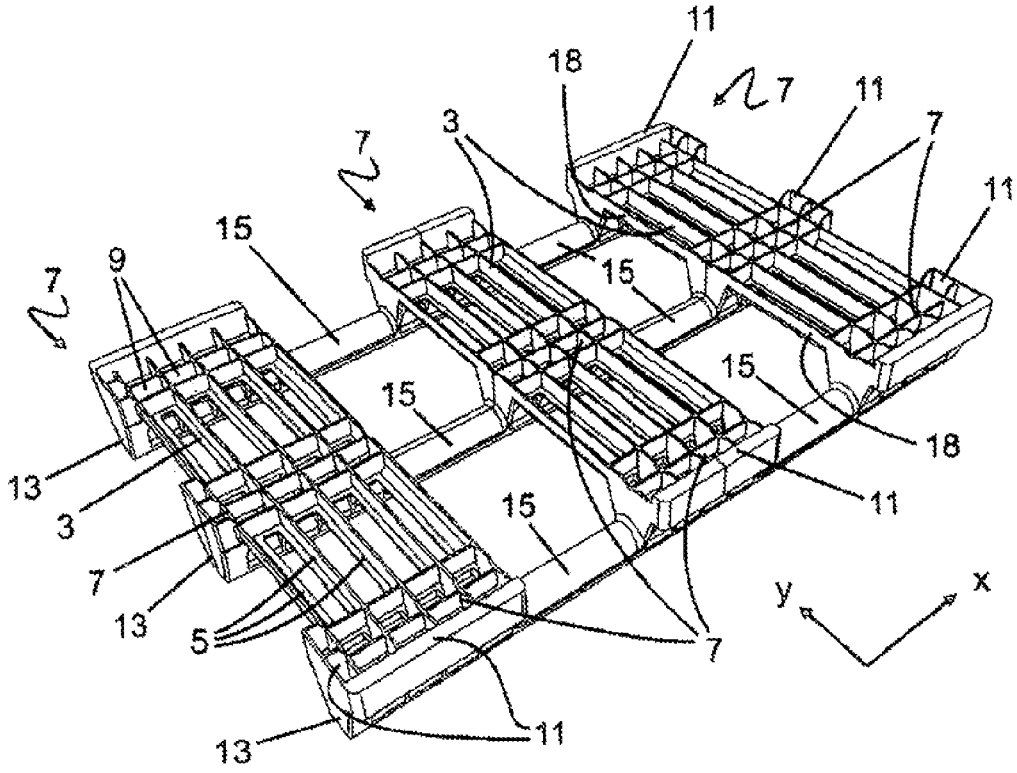
FIG. 1 an isometric illustration from above of a shuttle pallet according to the invention with three load bearing bridges.

In FIG. 1 a first embodiment of a shuttle pallet 1 according to the invention with a total of three load bearing bridges 3 is illustrated in an isometric view. The load bearing bridges 3 are embodied to be bending resistant in the direction of a Y axis and have a plurality of ribs 5 that substantially extend in the direction of the Y axis. The ribs 5, of which for reasons of clarity not all are provided with reference numerals, ensure the desired bending stiffness in the direction of the Y axis while providing at the same time minimal own weight.

In the area of the load bearing points 7 the ribs 5 are reinforced by transverse ribs 9. As a whole, there are nine load bearing points 7 that correspond to the load bearing points of conventional transport pallets with respect to arrangement and spacing. When, for example, a Euro pallet (not illustrated) as a typical representative of a transport pallet is positioned on the shuttle pallet according to the invention, the legs of the Euro pallet with their legs are positioned within the area of the load bearing points 7 on the shuttle pallet 1 and the weight force of the transport pallet or of the goods positioned thereon is therefore introduced by means of the load bearing points 7 into the shuttle pallet 1.

As can be clearly seen in the isometric illustration according to FIG. 1, an edge 11 of the shuttle pallet 1 is raised somewhat relative to the inner area so that a transport pallet (not illustrated) deposited onto the shuttle pallet is secured laterally and in all directions against sliding.

Below the load bearing points 7 there are legs 13 formed on the load bearing bridges 3. In accordance with the number of load bearing points 7 there are nine legs 13 provided on the shuttle pallet 1 according to the invention. In this way, it is ensured that the weight forces that are introduced through the load bearing points 7 into the shuttle pallet 1 can be directly transferred downwardly through the legs 13. In this way, the bending load of the shuttle pallet 1 according to the invention is minimized.

Between the legs 13 that are arranged in the direction of an X axis, corresponding to the longitudinal axis of the shuttle pallet 1, spacers 15 are provided that ensure that the load bearing bridges 3 are secured relative to one another in the direction of the X axis. In the illustrated embodiment the spacers 15 and the load bearing bridges 3 are embodied as a monolithic part. It is however also possible to connect the spacers 15 detachably to the load bearing bridges 3 so that, when one or several parts (3, 15) of the shuttle pallet 1 according to the invention are damaged, they can be exchanged and continued use of the remaining parts is possible.

The load bearing bridges 3 are designed such that they can be easily engaged from below by a fork of a rack servicing device (not illustrated). For this purpose, between the legs 13 of a load bearing bridge 3 cutouts 18 are provided. The rack servicing device engages the shuttle pallet 1 from below with its fork and deposits the loaded shuttle pallet 1 at the storage location.

Figure 2:
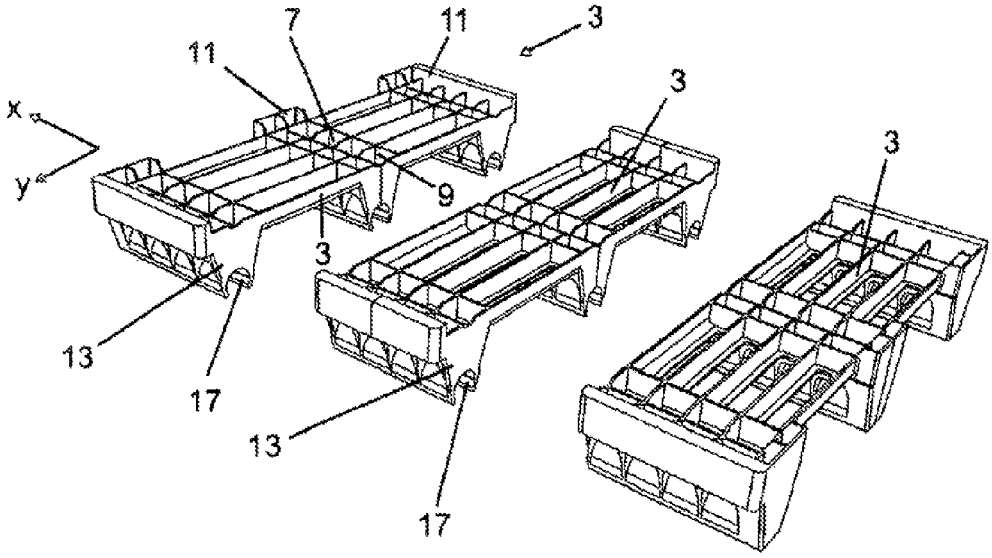
FIG. 2 the load bearing bridges according to FIG. 1 without spacers.

In FIG. 2 three load bearing bridges 3 without spacers are illustrated. This makes clear that the shuttle pallet 1 according to the invention is torsionally soft so that the shuttle pallet 1 can distort when, for example, it is deposited onto an uneven support or when it glides across a roller conveyor where not all rollers are precisely aligned within one plane. The shuttle pallet 1 is still torsionally soft when provided with the spacers 15.

Same components are provided with same reference numerals and, accordingly, the explanations provided in connection the other Figures apply as well. For reasons of clarity, not all reference numerals are provided in all Figures.

As can be seen clearly in FIG. 2, in the legs 13 of the load bearing bridges 3 snap-on connectors 17 is formed with a circular segment-shaped cross-section. These snap-on connectors 17 extend in the direction of the X axis and serve for receiving a longitudinal support (not illustrated) that is preferably comprised of steel pipe with circular cross-section. On the ends of the shuttle pallet 1 these snap-on connectors 17 are closed so that the longitudinal support cannot slide in the direction of the X axis relative to the load bearing bridges 3.

Figure 3A:
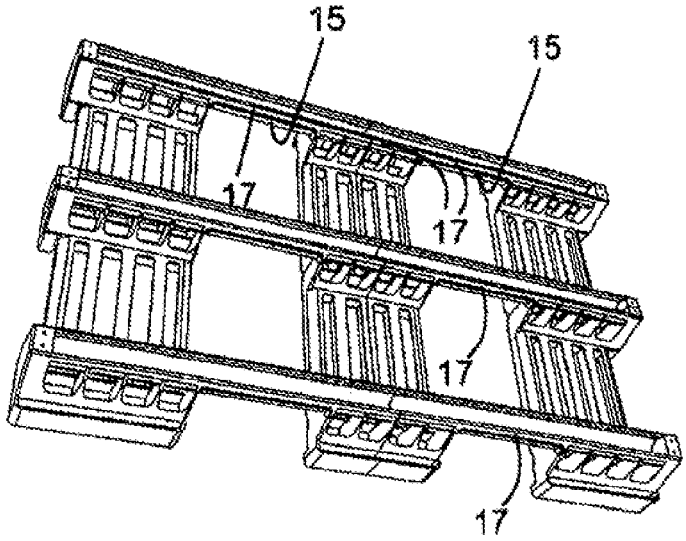
FIG. 3 a view of the shuttle pallet according to the invention without and with inserted longitudinal supports.

In FIG. 3*a*, the shuttle pallet 1 according to FIG. 1 is illustrated isometrically in a bottom view. This makes clear that these snap-on connectors 17 extend across the entire length of the shuttle pallet 1 and are also formed within the spacers 15.

Figure 3B:
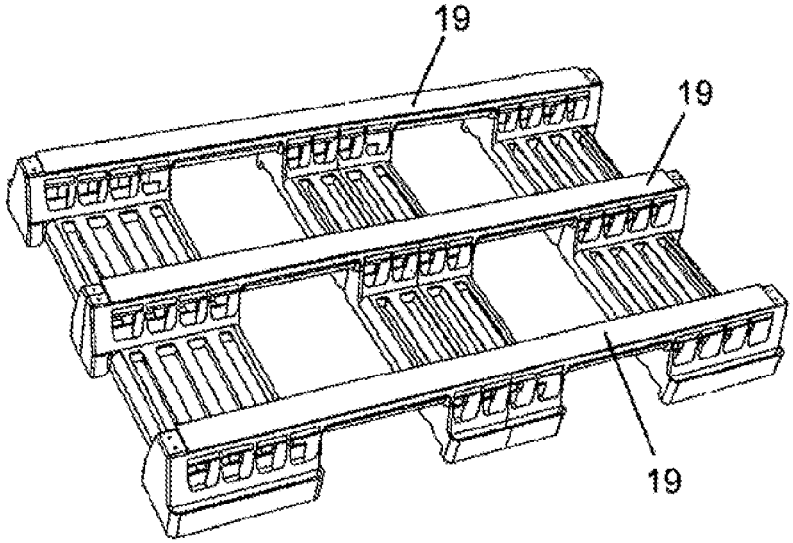

In FIG. 3*b*, longitudinal supports 19 are inserted into the snap-on connectors 17. In this way, a form fitting and at the same time detachable connection between the longitudinal supports 19 and the legs 13 as well as the spacers 15 of the shuttle pallet 1 is produced. The longitudinal supports 19 can be made of conventional steel pipe with circular ring-shaped cross-section and are firstly inexpensive and secondly wear resistant and thirdly bending resistant. In this way, the shuttle pallet 1 according to the invention can be loaded with great weights without the shuttle pallet sagging even in case of extended residence time at a storage location.

Figure 4:
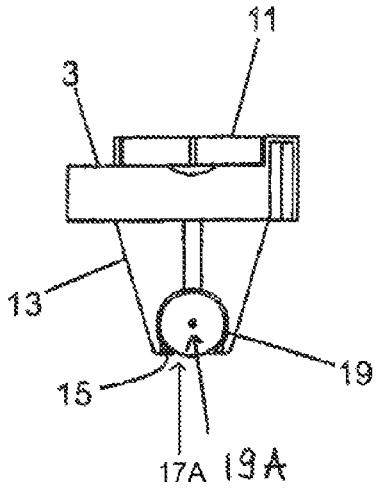
FIG. 4 a front view of a leg and with clipped-on longitudinal support.

In FIG. 4 a cross-section of a leg 13 with inserted longitudinal support 19 is illustrated. In this embodiment, the longitudinal support 19, as in the other embodiments, is embodied as a pipe with circular ring-shaped cross-section and has a longitudinal axis 19A coinciding with an axis of rotation of the longitudinal support 19 in the snap-on connector 17. The snap-on connector 17 is comprised of a circular segment section that encompasses more than 180° and is open in the downward direction. In this way, it is possible to insert from below the longitudinal support 19 into the receiving space 17A of the snap-on connector 17. Accordingly, for a short period of time the snap-on connector 17 or the leg 13 is briefly widened laterally and elastically returns into its original position as soon as the longitudinal support 19 has assumed the position, illustrated in FIG. 4, within the leg 13.

At the bottom the longitudinal support 19 projects somewhat past the leg 13 so that the contact between a roller conveyor or a support onto which the shuttle pallet is placed is exclusively realized through the longitudinal support 19 and not through the leg 13.

Figure 5:
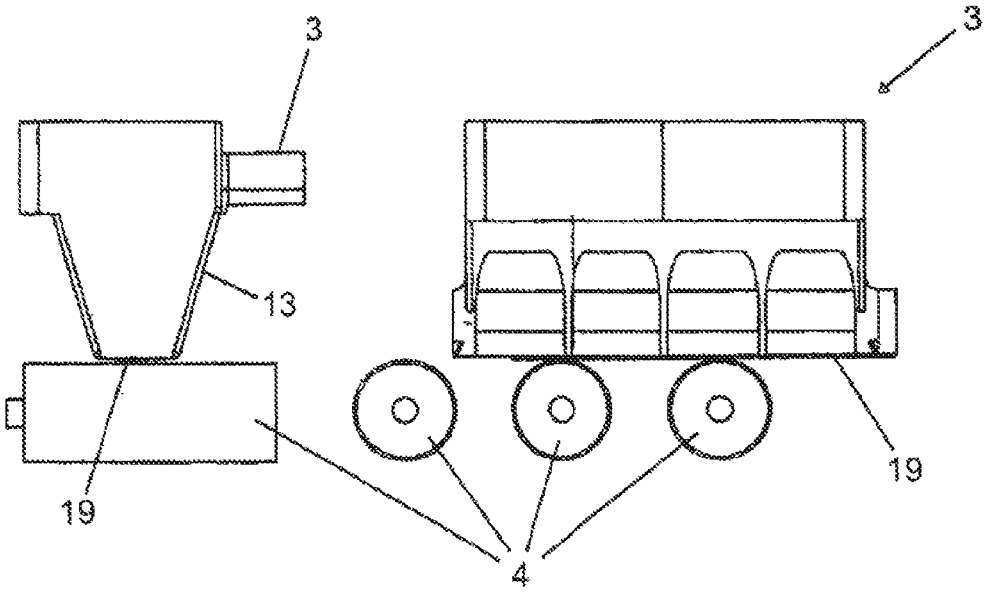
FIG. 5 a front view and a side view of a shuttle pallet according to the invention on a roller conveyor.

In FIG. 5 a portion of a shuttle pallet according to the invention is illustrated as it glides across a roller conveyor. In the right portion of FIG. 5, a side view is illustrated. This makes it clear that the longitudinal support 19 is in direct contact with the rollers 21 of the roller conveyor. In this way, the wear on the shuttle pallet is greatly reduced.

Should one of the longitudinal supports 19 as a result of frequent use become worn or damaged to such an extent, it can be exchanged on site without tools and in a very short period of time.

Figure 6:
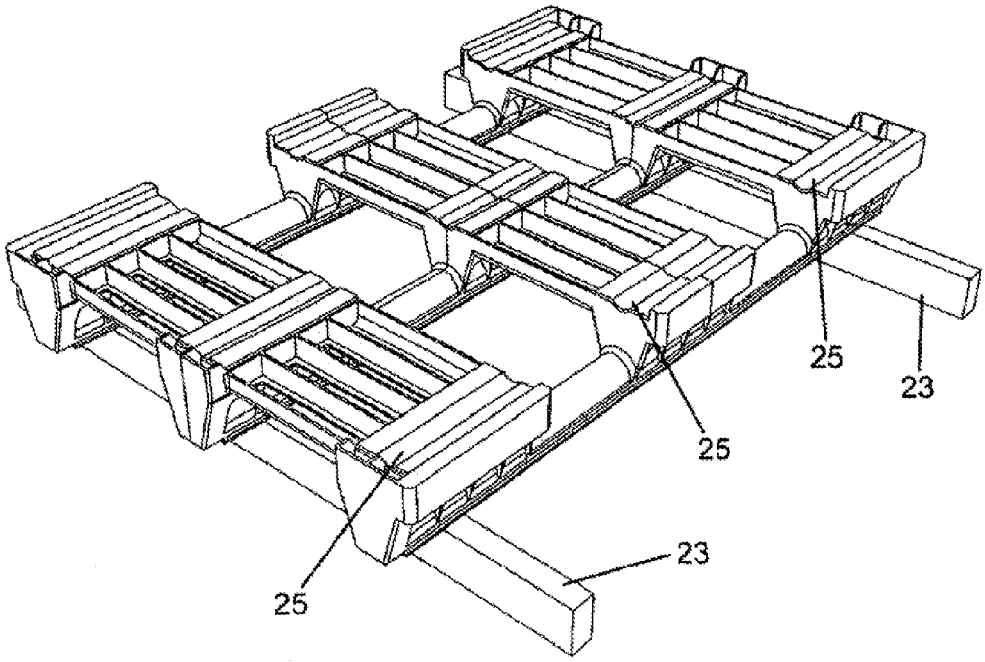
FIG. 6 a shuttle pallet with reinforced load bearing points.

In FIG. 6 a further embodiment of a shuttle pallet according to the invention is illustrated. In this connection, the shuttle pallet is positioned on two beams 23 of a high rack storage facility. The spacing of the beams 23 relative to one another corresponds to the spacing that such beams 23 have in conventional high rack storage facilities and is naturally matched to the length of the Euro pallet or the shuttle pallet.

In the embodiment illustrated in FIG. 6 the load bearing points 7 are provided with reinforcements 25 that prevent wear of the shuttle pallet in this area. These reinforcements can be embodied as shells 25 or sheet metal strips. Here also, for reasons of clarity, not all shells 25 are provided with reference numerals.

Because of the great bending stiffness of the longitudinal supports 19 (not visible in FIG. 6) the shuttle pallet according to the invention will not bend even when it is resting on the beams 23 for an extended period of time and loaded with a high weight. In this way, it is possible to even store in a high rack storage facility plastic pallets or nesting pallets of plastic material that, without the additional reinforcement by means of the longitudinal supports 19 according to the invention, over the course of time will bend under the load and therefore cause disruptions in the high rack storage facility.

Figure 7:
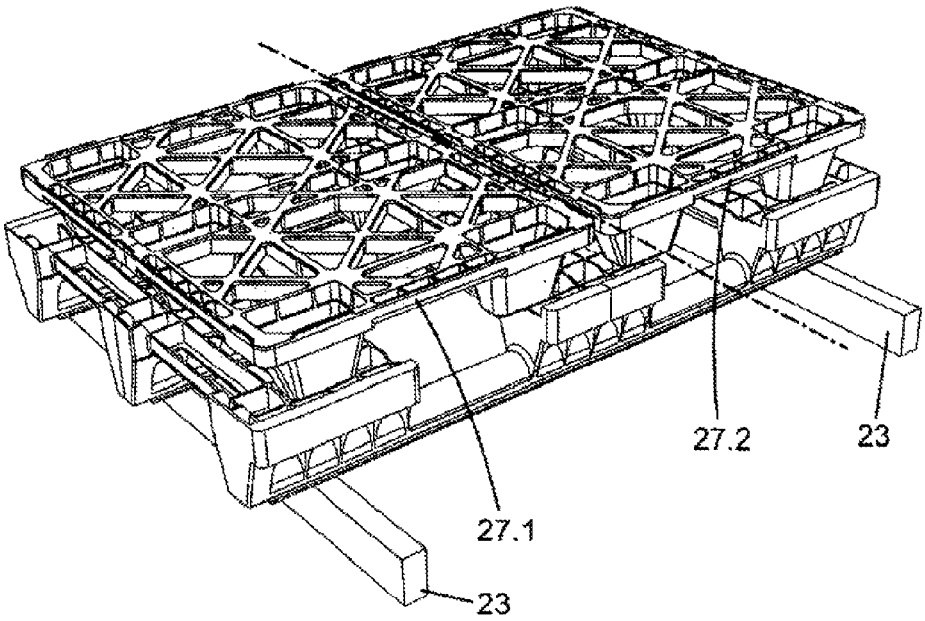
FIG. 7 a shuttle pallet with two half-size pallets positioned thereon.

In FIG. 7, a shuttle pallet according to the invention is illustrated that is loaded with two transport pallets 27.1 and 27.2 of half size format. This is possible without problems because the load bearing points 7 have an appropriate size. A line of separation between the two transport pallets of half size is identified by reference numeral 29.

Figure 8:
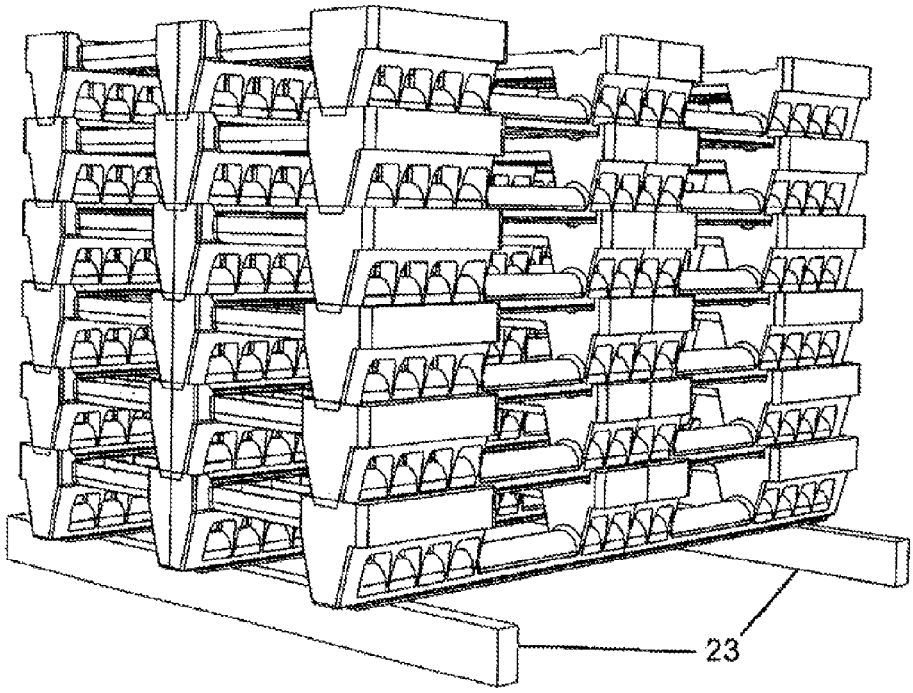
FIG. 8 several stacked shuttle pallets according to the invention.

In FIG. 8, several stacked shuttle pallets are illustrated that are located at a free spot within the high rack storage facility and whose lowermost one is resting on two beams 23.

Figure 9A:
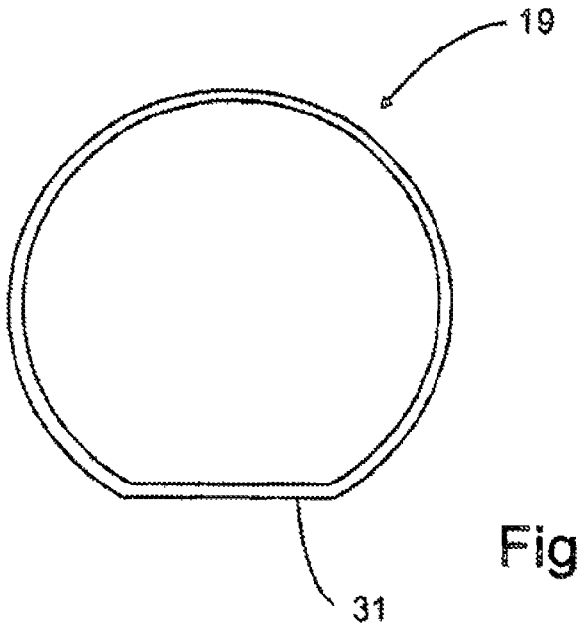
FIG. 9 several embodiments of suitable cross-sections of longitudinal supports.

In FIG. 9*a*, a longitudinal support 19 is illustrated in cross-section. In this embodiment, the circular ring-shaped cross-section has a flattened portion 31. In the mounted state, the flattened portion 31 faces downwardly and enlarges in this way the contact surface between longitudinal support 19 and the rollers 21 of a roller conveyor (see FIG. 5).

Figure 9B:
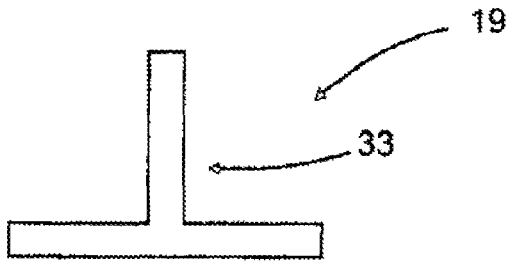

In FIG. 9*b* a longitudinal support 19 is shown in cross-section. In this embodiment, the longitudinal support 19 is formed as a T-shaped profiled section 33. In this way, the contact surface between longitudinal support 19 and the rollers 21 of a roller conveyor is enlarged.

Figure 9C:
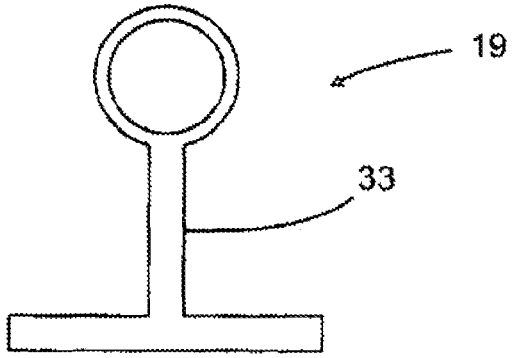

In FIG. 9*c* a longitudinal support 19 is shown in cross-section. In this embodiment, a T-shaped profiled section and a circular ring-shaped section are combined. The circular ring-shaped section serves for attachment of the longitudinal support 19 on the load bearing bridges 3 while the T-shaped profiled section 33 forms the contact surface between longitudinal supports 19 and conveying and storage equipment (21, 23).

What is claimed is:

1. A shuttle pallet for a high rack storage facility that comprises storage locations configured for storing goods positioned on pallets, the shuttle pallet comprising:

three longitudinal supports extending parallel relative to one another;

at least two load bearing bridges orthogonally extending relative to the longitudinal supports, wherein the longitudinal supports and the load bearing bridges are connected to one another in an articulated fashion;

wherein the longitudinal supports are made of a wear-resistant and bending-resistant semi-finished product;

wherein the longitudinal supports are form-fittingly and exchangeably connected to the load bearing bridges;

wherein the longitudinal supports have in cross-section an area with a circular ring-shaped cross-section;

wherein the at least two load bearing bridges have legs;

further comprising spacers disposed between adjacently positioned ones of the at least two load bearing bridges and extending in the direction of the longitudinal supports;

further comprising snap-on-connectors with a receiving space of a circular segment-shaped cross-section, said snap-on connectors including first snap-on connectors that are formed on the legs and second snap-on connectors that are formed on the spacers;

wherein said snap-on connectors receive the circular ring-shaped cross-section of the longitudinal supports in the receiving space, respectively, so that the longitudinal supports are rotatably supported in said snap-on connectors about an axis of rotation coinciding with a longitudinal axis of the longitudinal supports, wherein the longitudinal supports are exchangeably disposed in the snap-on connectors, respectively;

wherein the longitudinal supports are secured in said snap-on connectors across an entire length of the shuttle pallet.

2. The shuttle pallet according to claim 1, wherein the longitudinal supports are comprised of a pipe with circular ring-shaped cross-section.

3. The shuttle pallet according to claim 2, wherein the pipe has a flattened portion.

4. The shuttle pallet according to claim 2, wherein the longitudinal supports have a T-shaped cross-sectional area.

5. The shuttle pallet according to claim 1, wherein the load bearing bridges are embodied to be bending-resistant in a direction orthogonal to the longitudinal supports.

6. The shuttle pallet according to claim 1, wherein the spacers and the load bearing bridges are formed together as a monolithic part.

7. The shuttle pallet according to claim 1, wherein the load bearing bridges are comprised of plastic material.

8. The shuttle pallet according to claim 7, wherein the plastic material is selected from HDPE, recycled plastic material, or a combination of HDPE and recycled plastic material.

9. The shuttle pallet according to claim 1, wherein on a bottom side of the shuttle pallet two cutouts are provided that extend in a longitudinal direction of the shuttle pallet.

10. The shuttle pallet according to claim 9, wherein a spacing of central axes of the cutouts relative to one another is between 340 mm and 400 mm.

11. The shuttle pallet according to claim 10, wherein the spacing is 370 mm.

12. The shuttle pallet according to claim 9, wherein a height of the cutouts is greater than 85 mm and a width of the cutouts is greater than 160 mm.

13. The shuttle pallet according to claim 9, wherein dimensions of the cutouts correspond to standardized dimensions of transport pallets.

14. The shuttle pallet according to claim 9, wherein on a topside of the shuttle pallet load bearing points are provided and spacings of the load bearing points from one another correspond to spacings of legs of a standardized pallet.

15. The shuttle pallet according to claim 14, wherein the topside of the shuttle pallet has reinforcements in the area of the load bearing point.

16. The shuttle pallet according to claim 15, wherein the reinforcements are comprised of shells of a wear-resistant material.

17. The shuttle pallet according to claim 16, wherein the shells are made of sheet steel.

* * * * *